US007718115B2

(12) United States Patent
Every

(10) Patent No.: US 7,718,115 B2
(45) Date of Patent: May 18, 2010

(54) METHOD OF FORMING HOLLOW PART

(75) Inventor: Joseph Jeffery Every, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 2 days.

(21) Appl. No.: 12/219,498

(22) Filed: Jul. 23, 2008

(65) Prior Publication Data

US 2010/0021333 A1 Jan. 28, 2010

(51) Int. Cl.
*B22F 3/06* (2006.01)
*B22F 5/12* (2006.01)
*B29C 41/04* (2006.01)

(52) U.S. Cl. ..... 419/5; 419/36; 264/310; 264/319

(58) Field of Classification Search ..... 419/5, 419/6, 36; 264/311, 636, 637, 310, 319
See application file for complete search history.

(56) References Cited

U.S. PATENT DOCUMENTS

| | | | | |
|---|---|---|---|---|
| 2,341,739 | A | 2/1944 | Olt | |
| 2,390,160 | A | 12/1945 | Marvin | |
| 2,435,227 | A | 2/1948 | Lester | |
| 2,461,765 | A | 2/1949 | Olt | |
| 2,557,971 | A | 6/1951 | Jacklin, Jr. | |
| 2,593,943 | A | 4/1952 | Wainer | |
| 2,936,505 | A | 5/1960 | Witucki et al. | |
| 3,363,479 | A | 1/1968 | Pickels | |
| 3,689,614 | A | 9/1972 | Bortz et al. | |
| 4,005,741 | A | 2/1977 | Juganson et al. | |
| 4,666,640 | A | 5/1987 | Neefe | |
| 4,828,930 | A * | 5/1989 | Koehler | 428/547 |
| 5,316,701 | A | 5/1994 | Payne | |
| 6,082,989 | A | 7/2000 | McNally | |
| 6,296,044 | B1 | 10/2001 | Brooks et al. | |
| 6,649,106 | B2 | 11/2003 | Sakaguchi et al. | |
| 6,759,004 | B1 | 7/2004 | Dwivedi | |
| 7,160,496 | B2 | 1/2007 | Patel et al. | |
| 2007/0060463 | A1 * | 3/2007 | Gaumann | 501/1 |

OTHER PUBLICATIONS

Aartel® 800—Combined Data Sheet, (http://prospector.ides.com/datasheet.aspx?I=34&E97447), (visited Jun. 24, 2008) (2 pages).

* cited by examiner

*Primary Examiner*—Roy King
*Assistant Examiner*—Ngoclan T Mai
(74) *Attorney, Agent, or Firm*—Finnegan, Henderson, Farabow, Garrett & Dunner

(57) ABSTRACT

A method of forming a hollow part from a mixture is disclosed. The method may include rotationally molding the mixture into a green part. Additionally, the method may include debinding the green part into a brown part. The method may also include sintering the brown part into the hollow part.

17 Claims, 5 Drawing Sheets

METHOD OF FORMING HOLLOW PART

TECHNICAL FIELD

The present disclosure relates generally to a forming method and, more particularly, to a method of forming a hollow part.

BACKGROUND

Due to heightened environmental concerns, exhaust emission standards for machines have become increasingly stringent. To comply with these emission standards, machine manufacturers have increased the operating temperatures of the machines. The increased operating temperatures sometimes melt and/or warp hollow plastic parts of the machine, such as, for example, tanks, which may have complex features. Metal parts do not melt or warp at the increased operating temperatures. But, it is difficult to form hollow metal parts with complex features.

One way to form hollow metal parts is described in U.S. Pat. No. 2,390,160 (the '160 patent) issued to Marvin on Dec. 4, 1945. The '160 patent describes a method of forming hollow cylindrical objects from non-compacted metal powder. The method includes mixing the metal powder with a volatile organic solvent and a binder to form a slurry. Additionally, the method includes supplying a predetermined quantity of the slurry to a retaining shell held within a centrifuge. The method also includes rotating the shell to centrifugally distribute the powder to form a hollow cylindrical shape and simultaneously evaporate the solvent. In addition, the method includes removing the shell with the formed object therein. The method also includes sintering the object under suitable conditions of time, temperature and atmosphere for decomposing the binder and causing the particles of metal in the object to sinter together and form a hollow cylindrical object.

Although the method of the '160 patent may be used to form hollow cylindrical objects from non-compacted metal powder, using the method of the '160 patent may do little to form non-cylindrical hollow parts. Moreover, although the volatile organic solvent of the '160 patent may evaporate rapidly while the shell of the '160 patent is rotated, the volatile organic solvent may be subject to regulation and may be a potential health hazard.

The disclosed methods are directed to overcoming one or more of the problems set forth above and/or other problems in the art.

SUMMARY

In one aspect, the present disclosure may be directed to a method of forming a hollow part from a mixture. The method may include rotationally molding the mixture into a green part. Additionally, the method may include debinding the green part into a brown part. The method may also include sintering the brown part into the hollow part.

In another aspect, the present disclosure may be directed to another method of forming a hollow part from a mixture. The method may include rotationally molding the mixture into a green part. Additionally, the method may include debinding the green part in to a brown part. The debinding may include connecting a cavity interior to the green part to an atmosphere exterior to the green part. The debinding may also include exposing the green part to a catalyst. The method may also include sintering the brown part into the hollow part.

In yet another aspect, the present disclosure may be directed to a method of forming a hollow part from a mixture including a metal. The method may include rotationally molding the mixture into a green part. Additionally, the method may include debinding the green part in to a brown part. The debinding may include connecting a cavity interior to the green part to an atmosphere exterior to the green part. The debinding may also include exposing the green part to a catalyst. The method may also include sintering the brown part into the hollow part. The sintering may include heating the brown part to a temperature sufficient to fuse particles of the metal to each other. The temperature may also be below a melting point of the metal.

DETAILED DESCRIPTION

Figure 1:
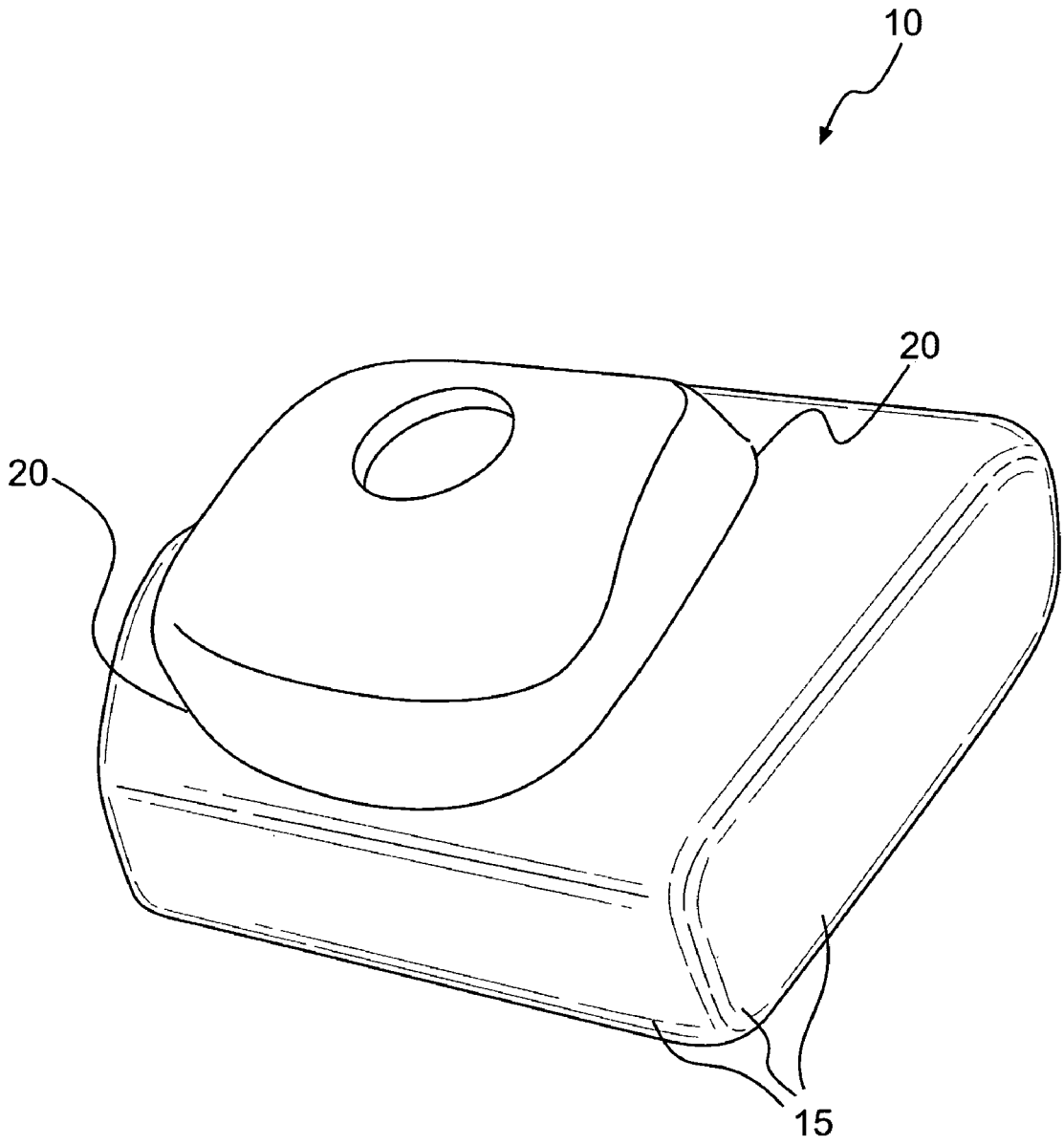
FIG. 1 is a pictorial illustration of an exemplary disclosed hollow part.

FIG. 1 illustrates an exemplary hollow part 10, which may not be subject to melting and/or warping at high temperatures. Hollow part 10 may be a unibody hollow part and may or may not include a complex geometry. For example, hollow part 10 may include radiussed edges 15 and complex curves 20. Hollow part 10 may embody, for example, a tank, a duct, or another hollow part that may or may not be located within close proximity to a heat source. The heat source may be, for example, a combustion engine of a machine.

Figure 2:
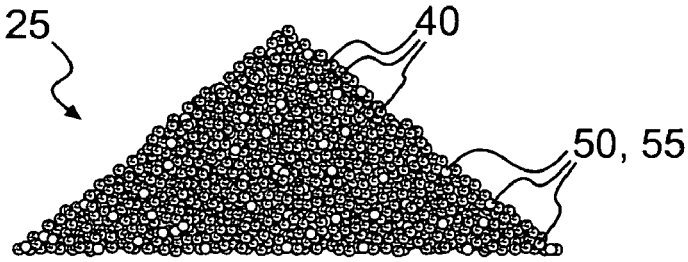
FIG. 2 is an illustration of an exemplary disclosed mixture.
Figure 3:
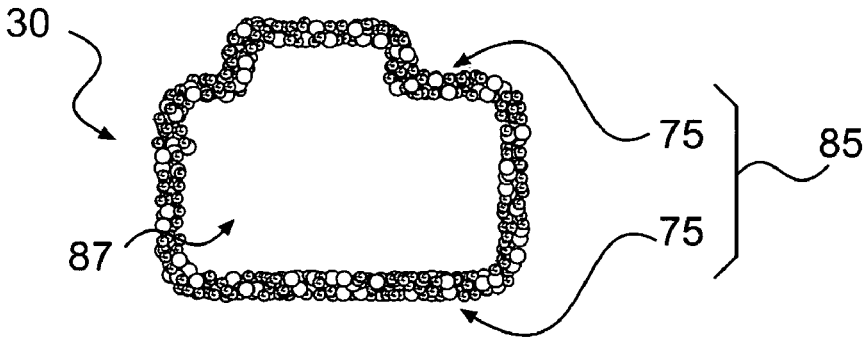
FIG. 3 is a cross-sectional illustration of an exemplary disclosed green part.
Figure 4:
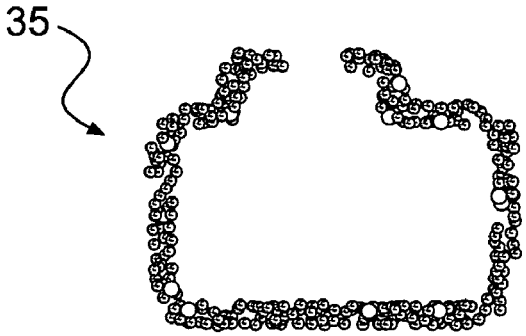
FIG. 4 is a cross-sectional illustration of an exemplary disclosed brown part.
Figure 5:
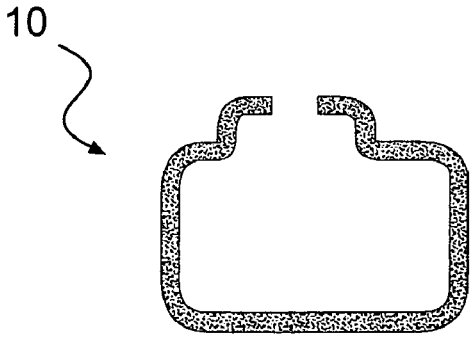
FIG. 5 is a cross-sectional illustration of the hollow part of FIG. 1.

As illustrated in FIG. 2, hollow part 10 may be formed from a mixture 25. A method of forming hollow part 10 (hereafter the "method") may include rotationally molding mixture 25 into a green part 30 (referring to FIG. 3). Green parts are parts that have been molded and not debinded. The method may also include debinding green part 30 into a brown part 35 (referring to FIG. 4). Brown parts are parts that have been at least partially debinded and not sintered. In addition, the method may include sintering brown part 35 into hollow part 10 (referring to FIG. 5).

Mixture 25 may include, as illustrated in FIG. 2, a metal 40. Metal 40 may include an elemental or alloyed metal. For example, the elemental or alloyed metal may include tungsten, rhenium tantalum, osmium, molybdenum, iridium, ruthenium, niobium, hafnium, nickel, iron, tin, cobalt, copper, uranium, stainless steel, stains less steel, brass, ferrochromium, ferrovanadium, ferrotungsten, aluminum bronze, magnesium bronze, or constantan. Alternatively, the elemental or alloyed metal may include another material having a high melting point. The high melting point may be sufficiently high to inhibit melting and/or warping of hollow part 10 formed from metal 40. Although metal 40 is represented in FIG. 2 by spheres, it should be understood that these spheres merely represent a powder or pellet form of the elemental or alloyed metal. This powder or pellet form of the elemental or alloyed metal may include particles with an average size conducive to sintering. For example, the average size of the particles may be less than 50 microns.

Mixture 25 may also include, as illustrated in FIG. 2, a binder 50. Binder 50 may include a polymer in the form of pellets 55. Alternatively, the polymer may be in the form of a powder. The polymer may have a melt flow rate conducive to rotational molding. This melt flow rate (as measured according to ISO 1133) may be greater than 0.1 $in^3$/10 minutes measured at 190 degrees Celsius employing a 2.16 kilogram weight (hereafter "greater than 0.1 $in^3$/10 minutes"). For example, the polymer may include polyethylene, nylon, PVC plastisol, polypropylene, polyoxymethylene, or another polymer with a melt flow rate greater than 0.1 $in^3$/10 minutes. The polymer may also have a melting point below the melting point of metal 40. Additionally, the polymer may carbonize at a temperature below the melting point of metal 40. Although pellets 55 are illustrated as spherical, it is contemplated that pellets 55 may have other shapes.

As illustrated in FIG. 2, metal 40 and binder 50 may be mixed to form mixture 25. Although FIG. 2 illustrates metal 40 and binder 50 as distinct and separable components of mixture 25, it is contemplated that mixture 25 may be a homogeneous mixture. Metal 40 and binder 50 may be homogeneously mixed by way of extrusion. Specifically, a single screw or multi-screw extruder may pressurize and/or heat metal 40 and binder 50 together into blended pellets (not shown). These blended pellets may then be pulverized into powder form. Alternatively, the blended pellets may not then be pulverized into powder form. In yet another alternative, metal 40 and binder 50 may be homogeneously mixed by way of another method known in the art. As illustrated in FIG. 2, mixture 25 may include unequal amounts of metal 40 and binder 50. Specifically, mixture 25 may include an amount M of metal 40 and an amount B of binder 50. It is contemplated that amounts M and B may both represent volumes. Amount M may be at least one fourth as large as amount B. In other words, mixture 25 may include by volume at least 20% metal 40. In some embodiments, amount M may be larger than amount B. For example amount M may be 1.5 times as large as amount B. In other words, mixture 25 may include by volume 60% metal 40 and 40% binder 50.

As previously discussed, mixture 25 may be rotationally molded into green part 30. Rotationally molding (also known as rotomolding) a mixture into a part may include forming a part from the mixture using a hollow mold that is rotated about one or more axes. The rotational molding of mixture 25 into green part 30 may be similar to rotational molding of polymers. The rotational molding of polymers is known in the art. In particular, the rotational molding of mixture 25 into green part 30 may include placing mixture 25 into a mold 60 (referring to FIG. 6), sealing mold 60, heating mixture 25, rotating mold 60, cooling mixture 25, unsealing mold 60, and removing green part 30 from mold 60.

Figure 6:
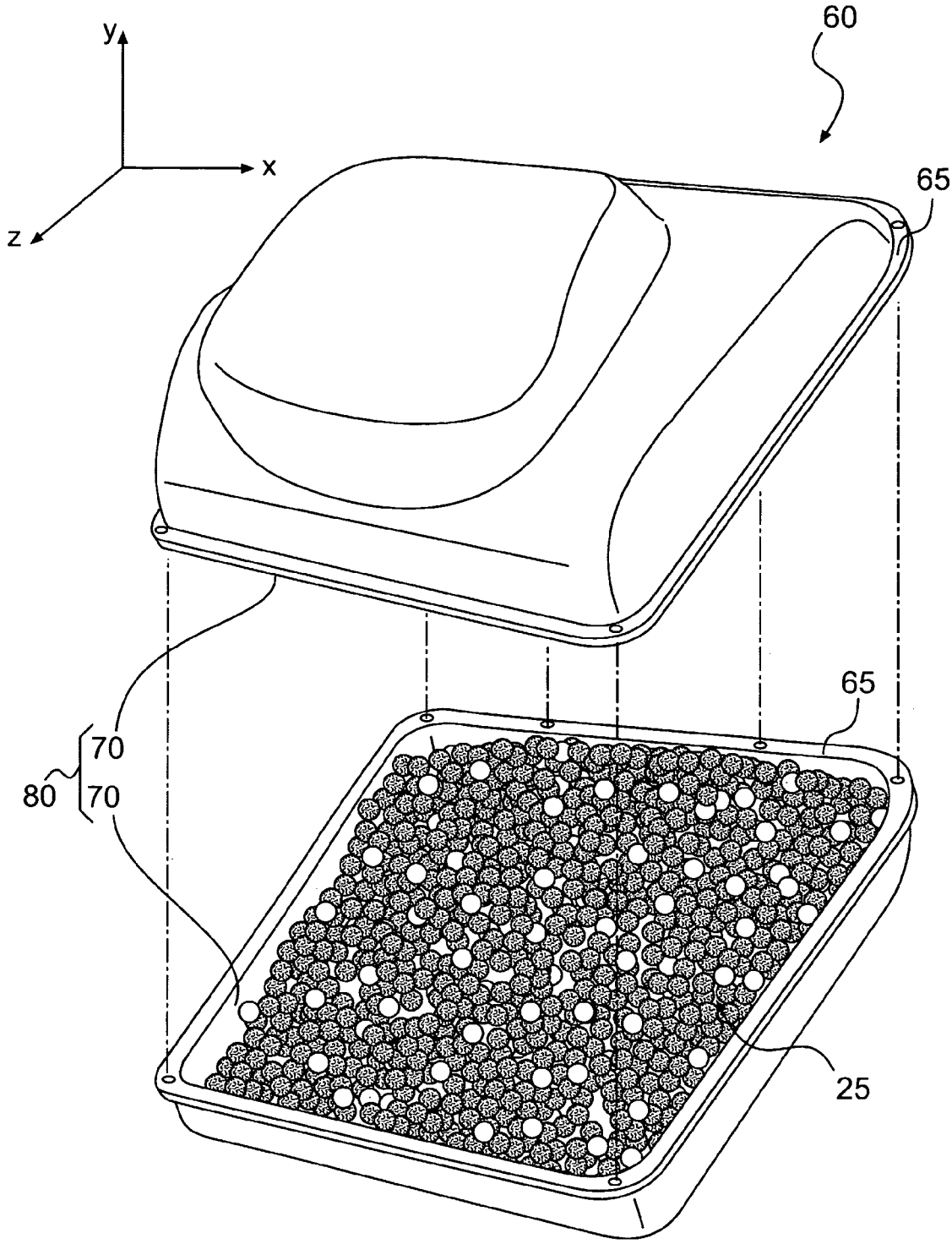
FIG. 6 is a pictorial illustration of the mixture of FIG. 2 within an exemplary disclosed mold.

As illustrated in FIG. 6, mold 60 may include two or more components 65. When components 65 are separated (as illustrated), mixture 25 may be placed on an interior surface 70 of one or more components 65. Each interior surface 70 may be equivalent to an exterior surface 75 of green part 30 (referring to FIG. 3). Thus, when components 65 are joined together to form mold 60, an interior surface 80 of mold 60 (a combination of each interior surface 70) may be equivalent to an exterior surface 85 of green part 30 (a combination of each exterior surface 75). Furthermore, although components 65 are illustrated without moving parts, it is contemplated that components 65 may have moving parts. These moving parts may improve a spreading of mixture 25.

After placing mixture 25 on interior surface 70, mold 60 may be sealed. This sealing may include joining components 65 to each other. This joining may be by way of bolt, screw, clamp, buckle, caulk, glue, or other joining mechanism. Mold 60 may then be rotated about one or more axes. For example, mold 60 may be rotated about an axis x, an axis y, and an axis z. It is contemplated that mold 60 may simultaneously be rotated about axes x, y, and z. Alternatively, mold 60 may be rotated about one or more of axis x, y, or z at a time. Before or while mold 60 is rotated, mixture 25 may be heated. In some embodiments, mixture 25 may be heated before it is placed within mold 60. The heating may be by way of convection, conduction, induction or another form of heating known in the art. The heating may continue until a temperature of mixture 25 rises above the melting point of binder 50. As binder 50 melts and mold 60 rotates, mixture 25 may spread in one or more directions along interior surface 80. The heating and rotating may continue until mixture 25 spreads approximately evenly along interior surfaces 70. Spreading evenly means coating interior surfaces 70 with a layer of mixture 25 having a consistent depth as measured from each interior surface 70. If components 65 have moving parts, these moving parts may be moved during the heating and rotating to promote the spreading of mixture 25 to certain interior surfaces 70. Alternatively and whether or not components 65 have moving parts, some interior surfaces of mold 60 (not shown) may be configured so that the layer of mixture 25 has a varied depth. This varied depth may, for example, be caused by one or more protrusions from these interior surfaces.

Once mixture 25 has spread approximately evenly along interior surfaces 70 (excluding interior surfaces configured so that the layer of mixture 25 has a varied depth), the heating of mixture 25 may cease while the rotating of mold 60 may continue. As the rotating of mold 60 continues, mixture 25 may cool. As mixture 25 cools, mixture 25 may solidify into green part 30. It is contemplated that green part 30 may be capable of supporting itself once fully solidified. In other words, a cavity 87 (referring to FIG. 3) interior to green part 30 may not collapse when the rotating is discontinued. Therefore, the rotating may be discontinued when green part 30 has sufficiently solidified (i.e., when a temperature of green part 30 has decreased below the melting point of binder 50).

After the rotating of mold 60 has been discontinued, mold 60 may be unsealed. This unsealing may include separating components 65. Once mold 60 is unsealed, green part 30 (referring to FIG. 3) may be removed from mold 60. Green part 30 may then be debinded into brown part 35. Debinding a part may include removing at least a portion of a binder from the part. In particular the debinding of green part 30 into brown part 35 may include machining one or more holes 90 (referring to FIG. 7) into green part 30, placing green part 30 in a debinding mechanism 95 (referring to FIG. 7), and removing brown part 35 from debinding mechanism 95.

Figure 7:
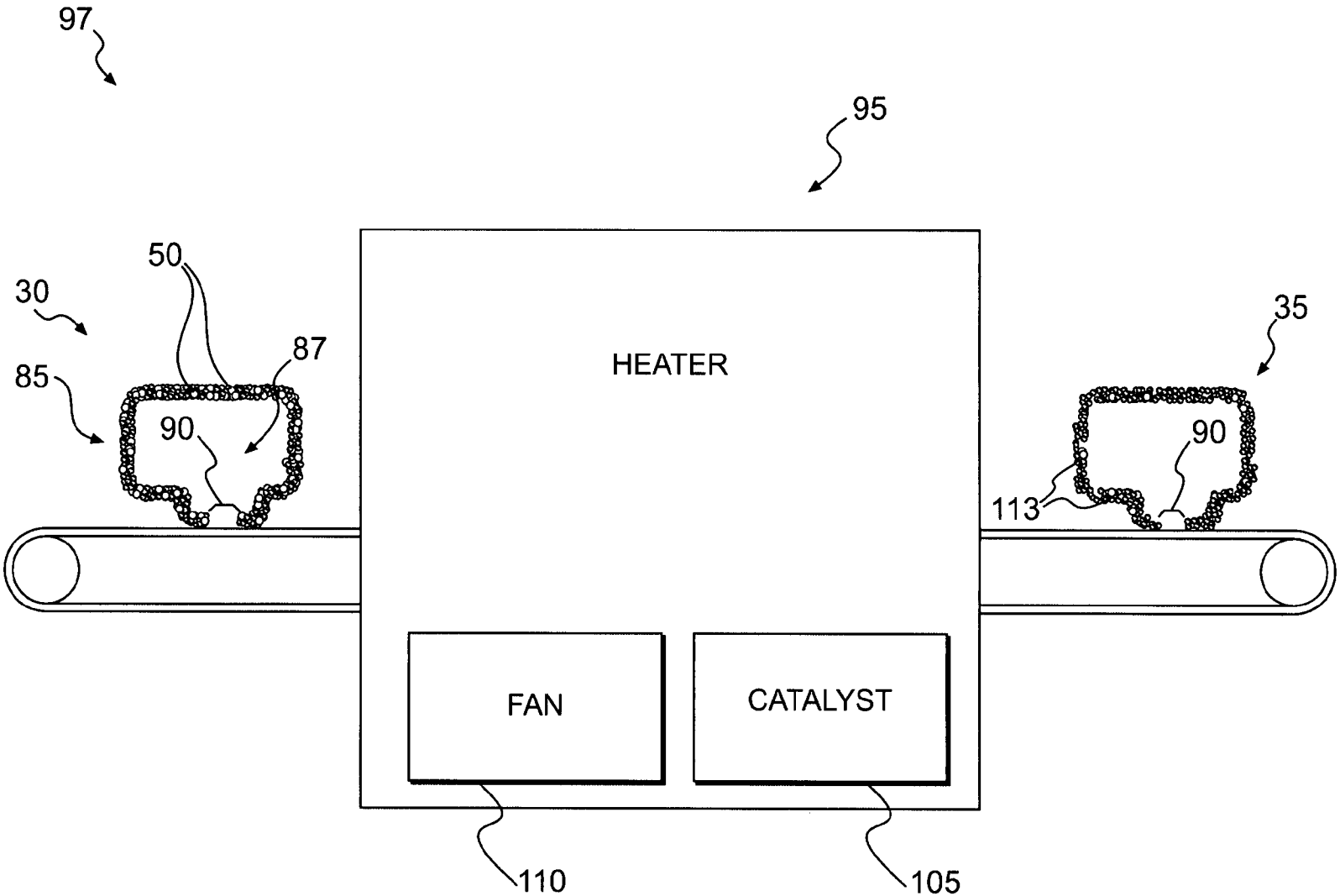
FIG. 7 is a cross-sectional illustration of a green part being debinded into the brown part of FIG. 4.

As illustrated in FIG. 7, hole 90 may connect cavity 87 to an atmosphere 97. Atmosphere 97 may include any fluid or fluids exterior to green part 30. Hole 90 may be sufficiently large to allow atmosphere 97 to flow into cavity 87. Hole 90 may be circular. Alternatively, hole 90 may be another shape. For example, if hollow part 10 is a tank, hole 90 may be shape configured to temporarily or permanently be joined to a filling or draining apparatus for the tank.

Debinding mechanism 95 may embody a heater and may include a catalyst 105 and a fan 110. Catalyst 105 may be an acid capable of dissolving binder 50. It is contemplated that catalyst 105 may be liquid or gaseous in form. Fan 110 may be positioned within debinding mechanism 95 to circulate catalyst 105. When green part 30 is placed in debinding mechanism 95, green part 30 may be positioned such that hole 90 faces fan 110. Thus, fan 110 may circulate catalyst 105 via atmosphere 97 into cavity 87. This circulation may be through hole 90 or exterior surface 85. In other words, catalyst 105 may pass through exterior surface 85. While green part 30 is in debinding mechanism 95, debinding mechanism 95 may heat green part 30. The combination of the heating of green part 30 and the exposure of green part 30 to catalyst 105 may result in a debinding of a portion of binder 50 from green part 30. In other words, a portion of binder 50 may be removed from green part 30. Only a portion 113 of binder 50 may remain. The removed portion of binder 50 may be more than three times as large as portion 113. In other words, the removed portion of binder 50 may include more than 75% of the amount of binder 50.

As previously discussed, brown part 35 may be sintered into hollow part 10. Sintering a part may include heating the part to a temperature below the part's melting point until the part's particles fuse to each other. In particular, the sintering of brown part 35 into hollow part 10 may include placing brown part 35 in a heating mechanism 115 (referring to FIG. 8), heating brown part 35, and removing brown part 35 from heating mechanism 115. During the heating of brown part 35, brown part 35 may be supported by a fixture (not shown). This fixture may prevent the heating of brown part 35 from undesirably deforming brown part 35.

Figure 8:
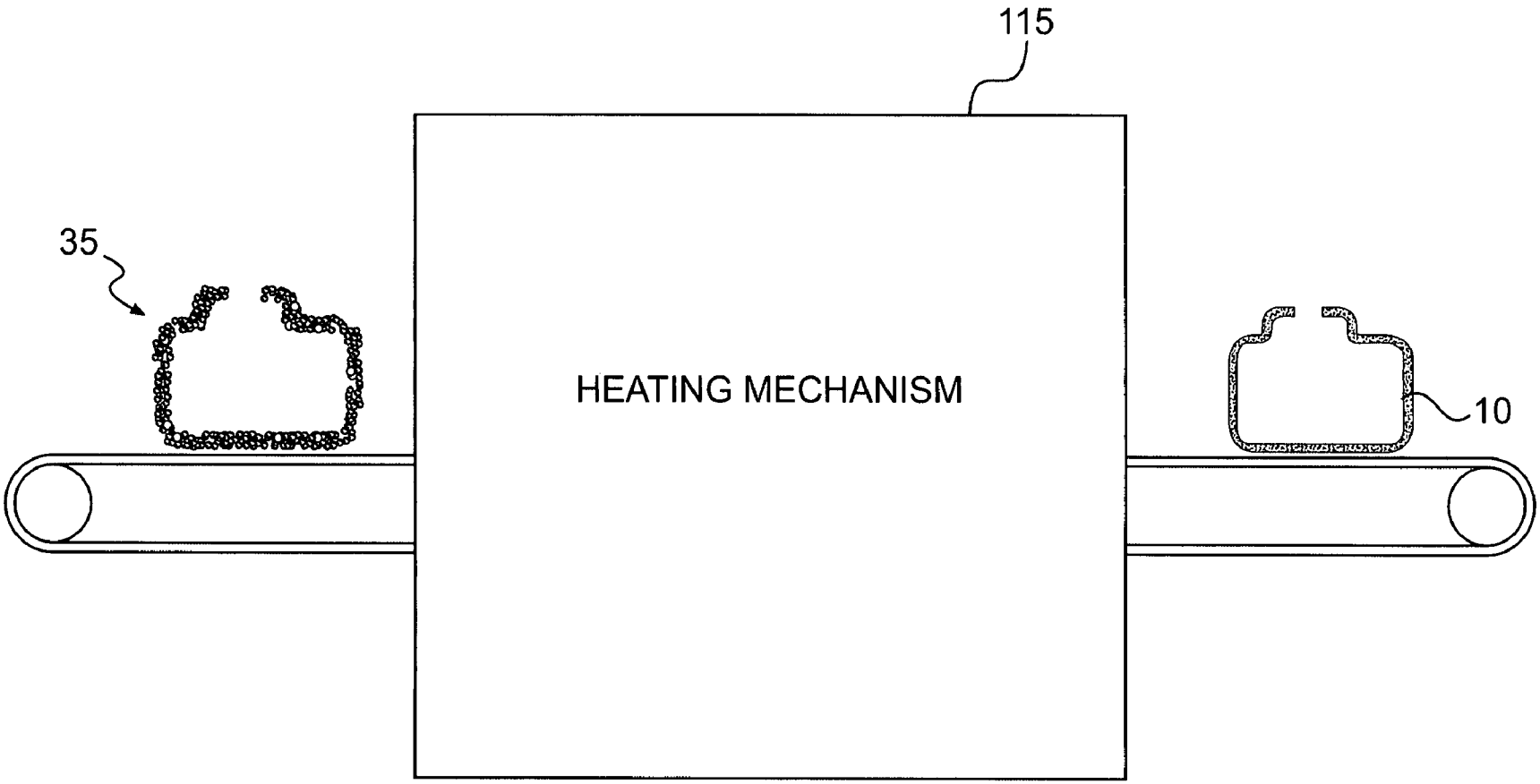
FIG. 8 is a cross-sectional illustration of the brown part of FIG. 4 being sintered into the hollow part of FIGS. 1 and 5.

As illustrated in FIG. 8, heating mechanism 115 may embody a heater. It is contemplated that heating mechanism 115 and debinding mechanism 95 may together embody a single integral component. Heating mechanism 115 may heat brown part 35 to a temperature sufficient to fuse the particles of metal 40 to each other. This temperature may be below the melting point of metal 40. The heating of brown part 35 may result in a carbonizing of portion 113. The heating of brown part 35 may also result in the particles of metal 40 fusing to each other. When the particles of metal 40 fuse to each other, brown part 35 may shrink into hollow part 10. Hollow part 10 may occupy less than 90% of a volume of brown part 35. In other words, the sintering of brown part 35 into hollow part 10 may shrink a volume of brown part 35 by more than 10%.

INDUSTRIAL APPLICABILITY

The disclosed method may be applicable to a mixture, which may be rotationally molded to form a hollow part. This hollow part may have complex features and may be capable of withstanding high temperatures without melting and/or warping. Thus, the hollow part may be efficiently located within close proximity to a heat source such as, for example, a combustion engine of a machine.

It is contemplated that the method of forming hollow part 10 may be conducive to forming hollow parts 10 from metal 40. These metal hollow parts 10 may be capable of withstanding higher temperatures than similar plastic hollow parts. Specifically, metal hollow parts 10 may not melt and/or warp at the higher temperatures. Moreover, the method of forming metal hollow parts 10 may be environmentally friendly as it may require no volatile organic solvents.

Additionally, it is contemplated that the method of forming metal hollow parts 10 may efficiently yield unibody metal hollow parts 10. In particular, the method may be highly repeatable as it requires no welding or casting. Also, the lack of welding and casting may minimize quality control issues. Additionally, the unibody structure of metal hollow parts 10 may minimize possible leak points.

It is also contemplated that the method of forming hollow parts 10 may produce hollow parts 10 with low stress radiussed edges 15. These low stress radiussed edges 15 may maximize the durability of hollow part 10.

It will be apparent to those skilled in the art that various modifications and variations can be made to the methods of the present disclosure. Other embodiments of the methods will be apparent to those skilled in the art from consideration of the specification and practice of the methods disclosed herein. It is intended that the specification and examples be considered as exemplary only, with a true scope of the disclosure being indicated by the following claims and their equivalents.

What is claimed is:

1. A method of forming a hollow part from a mixture, comprising:
- rotationally molding the mixture into a green part;
- debinding the green part into a brown part, the debinding including:
  - connecting a cavity interior to the green part to an atmosphere exterior to the green part; and
  - exposing the green part to a catalyst; and
- sintering the brown part into the hollow part.

2. The method of claim 1, wherein the mixture includes a metal and a binder.

3. The method of claim 2, wherein the metal includes by volume at least 20% of the mixture.

4. The method of claim 2, wherein the metal includes particles having an average size of less than 50 microns.

5. The method of claim 4 wherein the metal includes stainless steel.

6. The method of claim 2, wherein the binder has a melt flow rate greater than 0.1 $in^3$/10 minutes measured at 190 degrees Celsius employing a 2.16 kilogram weight.

7. The method of claim 6, wherein the binder includes polyoxymethylene.

8. The method of claim 1, wherein the rotationally molding of the mixture into the green part includes:
- placing the mixture into a mold;
- rotating the mold; and
- heating the mixture.

9. The method of claim 8, wherein:
- the mixture includes a binder; and
- the heating of the mixture includes heating the mixture to a temperature above a melting point of the binder.

10. The method of claim 1, wherein:
- the mixture includes an amount of a binder; and
- the debinding of the green part into the brown part includes removing a portion of the amount of the binder, the portion of the amount of the binder including more than 75% of the amount of the binder.

11. The method of claim 1, wherein:
- the mixture includes a metal; and
- the sintering of the brown part into the hollow part includes heating the brown part to a temperature:
  - sufficient to fuse particles of the metal to each other; and
  - below a melting point of the metal.

12. The method of claim 1, wherein the sintering of the brown part into the hollow part includes shrinking a volume of the brown part by more than 10%.

13. The method of claim 1, wherein the connecting of the cavity interior to the green part to the atmosphere exterior to the green part includes machining a hole into the green part.

14. The method of claim 1, wherein the exposing of the green part to the catalyst includes circulating the catalyst via the atmosphere into the cavity.

15. The method of claim 1, wherein the exposing of the green part to the catalyst includes passing the catalyst through a surface of the green part.

16. The method of claim 1, wherein the catalyst includes a liquid acid.

17. The method of claim 1, wherein the debinding further includes heating the green part.

* * * * *